US005195165A

United States Patent [19]

Ono et al.

[11] Patent Number: 5,195,165

[45] Date of Patent: Mar. 16, 1993

[54] QUARTZ TUBE HEAT GENERATOR WITH CATALYTIC COATING

[75] Inventors: Yukiyoshi Ono, Hirakata; Atsushi Nishino, Neyagawa; Hironao Numoto, Katano, all of Japan

[73] Assignee: Matsushita Electric Industrial Co., Ltd., Osaka, Japan

[21] Appl. No.: 523,423

[22] Filed: May 15, 1990

[30] Foreign Application Priority Data

May 18, 1989 [JP] Japan ..... 1-124853

[51] Int. Cl.[5] ..... F26B 3/30; F24C 7/00

[52] U.S. Cl. ..... 392/407; 219/553; 422/177; 338/262

[58] Field of Search ..... 219/553, 548; 392/407, 392/391; 422/180, 177, 22; 313/110, 113; 338/262-266

[56] References Cited

U.S. PATENT DOCUMENTS

| | | | |
|---|---|---|---|
| 3,179,789 | 4/1965 | Gialanella . | |
| 3,362,783 | 1/1968 | Leak | 422/180 |
| 3,779,710 | 12/1973 | Burstein et al. | 219/553 |
| 3,930,796 | 1/1976 | Haensel | 422/180 |
| 4,023,928 | 5/1977 | Haensel | 392/375 |
| 4,188,309 | 2/1980 | Volker et al. | 422/177 |
| 4,426,570 | 1/1984 | Hikino et al. | 219/553 |
| 4,626,659 | 12/1986 | Charmes et al. | 422/122 |

FOREIGN PATENT DOCUMENTS

| | | | |
|---|---|---|---|
| 1615334 | 10/1970 | Fed. Rep. of Germany . | |
| 55-33595 | 9/1980 | Japan | 392/407 |
| 63-292591 | 1/1988 | Japan | 392/407 |
| 63-276890 | 11/1988 | Japan | 392/408 |
| 64-77893 | 1/1989 | Japan . | |
| 1005559 | 9/1965 | United Kingdom . | |

*Primary Examiner*—Bruce A. Reynolds
*Assistant Examiner*—John A. Jeffery
*Attorney, Agent, or Firm*—Stevens, Davis, Miller & Mosher

[57] ABSTRACT

A heat generator comprising a quartz tube containing an electric resistor and a catalyst coating layer comprising at least active alumina, silica and a platinum group metal, formed on the surface of the quartz tube can heat a material to be heated and the catalyst coating layer itself because of the catalyst coating layer being provided on the surface of the quartz tube. The catalyst coating layer surrounds the quartz tube and thus efficiently absorbs heat from the electric resistor by radiation and heat conductance, whereby the catalyst coating layer can be heated to the activation temperature within a short time. Furthermore, the heat generator also heats air around the heat generator to circulate the air as a convection air stream around the heat generator. When the convection air stream contacts the catalyst in the catalyst coating layer heated to higher than the activation temperature by heating of the heat generator, smelly components or noxious components in the air stream are oxidized and purified by the catalytic action before leaving the heat generator.

16 Claims, 1 Drawing Sheet

QUARTZ TUBE HEAT GENERATOR WITH CATALYTIC COATING

BACKGROUND OF THE INVENTION (1) Field of the Invention

This invention relates to a heat generator for use in a room heater, water boiler, drier, etc.

(2) Prior Art

The conventional heat generators are metal wires such as nichrome wire and kanthal wire in a coiled state or encased in tubes such as a metallic tube, a quartz tube and ceramic tube, or further the tubes coated with cordierite, clay or glass, or a highly far infrared radiation material such as nickel oxide, iron oxide, etc., and ceramic heaters containing an electric resistor in sintered ceramics, etc. In room heaters, water boilers and driers, materials are heated by the heat generator through heat conduction, convection and radiation, for example, by direct heating from the heat generator, forced air blowing to the heat generator by a fan to generate heated air, or by providing a reflection heating.

However, the conventional heat generator has the following problems.

In case of room heating with an electric stove, the heat generator heats air in the room and also heats cigarette smoke or smells suspended in the room. Generally, the higher the temperature, the more sensitive to human noses are to the smelly components. Furthermore, the smelly components once adsorbed on the structural material or furnitures in the room are again vaporized and suspended in the room atmosphere. Since the conventional heat generator can not purify the smelling components, smells are often more sensitive when an electric stove is used in the room than when not. Such a phenomenon has been a problem.

SUMMARY OF THE INVENTION

An object of the present invention is to provide a heat generator capable of removing smells or noxious gases with a simple structure, thereby solving the problem of the prior art.

The present invention provides a heat generator, which comprises a quartz tube containing an electric resistor, and a catalyst coating layer comprising at least an active alumina, silica and a platinum group metal, provided on the surface of the quartz tube.

Since the heat generator tube is provided with the catalyst coating layer on the tube surface, the heat generator can heat both of a material to be heated and the catalyst coating layer. Furthermore, since the heat generator tube is surrounded by the catalyst coating layer, the catalyst coating layer can efficiently absorb heat from the electric resistor by radiation and conduction and thus can be heated to the activation temperature of the catalyst within a short time. The present catalyst coating layer contains silica and thus strong adhesion of the layer to the quartz tube can be obtained and also the heat conduction from the quartz tube can be carried out very rapidly. Furthermore, the heat generator also heats the air around the heat generator and thus an air stream as a convection circulates around the heat generator. When the air stream contacts the catalyst heated to more than the activation temperature by heating of the heat generator, the smelly components and noxious components in the air are oxidized and purified by the catalytic reaction before leaving the heat generator.

In the foregoing, the reaction of the spontaneous convection around the heat generator has been explained, but a more remarkable effect can be obtained when the air is forcedly blown into the heat generator by a fan.

The electric resistor for use in the present heat generator includes a metal wire, such as a nichrome wire or a kanthal wire, in a coiled form, and a tungsten wire, etc. sealed in a quartz tube together with an inert gas such as an argon gas, etc. The quartz tube for or use in the present invention is a tube of glass containing at least 95% by weight of silica.

The present catalyst coating layer contains silica. By inclusion of silica in the catalyst coating layer, strong adhesion of the catalyst coating layer to the quartz tube can be obtained.

It is desirable that the present catalyst coating layer contains 6 to 40% by weight of silica. Above 40% by weight of silica the catalyst coating layer is liable to crack, resulting in a decrease in the adhesion, whereas below 6% by weight of silica a sufficient effect of silica upon the improvement of adhesion cannot be obtained.

It is also desirable that the present catalyst coating layer have a specific surface area of at least 10 $m^2/g$. The far infrared radiation ratio, i.e. the amount of far infrared rays to be radiated, increases with increasing the specific surface area of the catalyst coating layer, and a sufficient far infrared radiation ratio can be obtained with a specific surface area of at least 10 $m^2/g$.

It is also desirable that the present catalyst coating layer contain cerium oxide. By inclusion of cerium oxide in the catalyst coating layer, not only the heat resistance of the catalyst coating layer, but also the catalytic oxidation activity to hydrocarbon compounds can be improved. It is desirable that the catalyst coating layer contains 5 to 30% by weight of cerium oxide. Above 30% by weight of cerium oxide, the heat resistance of the catalyst coating layer is lowered, whereas below 5% by weight a sufficient effect of cerium oxide cannot be obtained.

It is also desirable that the present catalyst coating layer contain barium oxide. By inclusion of barium oxide in the catalyst coating layer, the heat resistance of the catalyst coating layer can be improved. It is desirable that the present catalyst coating layer contains 1 to 10% by weight of barium oxide. Above 10% by weight of barium oxide, the adhesion of the catalyst coating layer is lowered, whereas below 1% by weight of barium oxide, a sufficient effect of barium oxide cannot be obtained.

Similar additive effect can be obtained with barium carbonate in place of barium oxide in the present invention. The amount of barium carbonate to be contained in the catalyst coating layer is 1 to 10% by weight in terms of barium oxide.

It is also desirable that the catalyst coating layer contain titanium oxide. By inclusion of titanium oxide in the catalyst coating layer, the catalytic oxidation activity to nitrogen compounds such as ammonia, etc. can be improved. It is desirable that the catalyst coating layer contains 4 to 30% by weight of titanium oxide. Above 30% by weight of titanium oxide, the adhesion of the catalyst coating layer is lowered, whereas below 4% by weight of titanium oxide, a sufficient effect of titanium oxide cannot be obtained.

In the formation of the present catalyst coating layer on the surface of a quartz tube, it is desirable to roughen the surface of a quartz tube and then provide a catalyst coating layer thereon, or to thoroughly defat the surface of a quartz tube and then provide a catalyst coating layer, whereby adhesion can be improved between the quartz tube and the catalyst coating layer.

The present catalyst coating layer can be formed in various ways, for example, by spray coating, dip coating, electrostatic coating, roll coating, screen printing, etc.

It is desirable that the particles in a slurry for forming the present catalyst coating layer have main particle sizes of 1 μm to 9 μm. Above 9 μm, the catalyst coating layer turns soft, whereas below 1 μm the catalyst coating layer is liable to crack.

In the present invention, silica means silicon dioxide, and silicic acid can be used in place of silica.

PREFERRED EMBODIMENTS OF THE INVENTION

The present invention will be described in detail, referring to embodiments and drawings.

EXAMPLE 1

1,000 g of active alumina powder, 1,000 g of colloidal alumina containing 10% by weight of alumina, 100 g of aluminum nitrate nonahydrate, 1,000 g of colloidal silica containing 20% by weight of silica, 1,200 g of water, 30 g of chloroplatinic acid in terms of Pt, and 15 g of palladium chloride in terms of Pd were added to a ball mill and thoroughly mixed to prepare a slurry A. The thus prepared slurry A was applied to the surface of a quartz tube, 10 mm in outer diameter, 9 mm in inner diameter, 15 cm long, by spray coating, dried at 100° C. for 2 hours and then fired at 500° C. for one hour to obtain a quartz tube with a catalyst coating layer. From the thus prepared quartz tube, a nichrome wire as an electric resistor and an insulator a heat generator A of the present invention was prepared.

The amount of the catalyst coating layer was 0.2 g, and the amounts of the platinum group metals contained were 5.12 mg of Pt and 2.56 mg of Pd.

Figure 1:
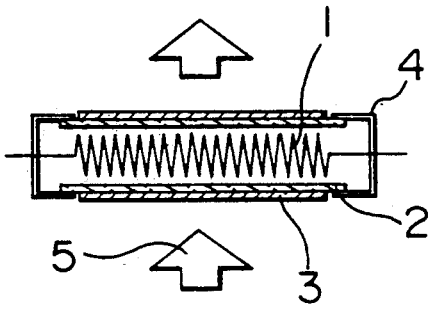
FIG. 1 is a view showing the structure and action according to one embodiment of the present heat generator.

The present heat generator had the structure in FIG. 1.

In FIG. 1, the present heat generator A comprises a nichrome wire 1 of 300 W, a quartz tube 2 and a catalyst coating layer 3 formed on the surface of the quartz tube 2, the heat generator A being insulated and supported by insulators 4.

When an electric current is passed through the nichrome wire 1, heat rays are emitted from the nichrome wire 1 in all the radial directions. The catalyst coating layer 3 is provided to cover the entire periphery of the quartz tube 2, and thus the catalyst coating layer 3 is irradiated with the heat rays emitted from the nichrome wire 1 in all the radial directions, and the radiation heating of the catalyst coating layer 3 can be efficiently carried out. At the same time, the catalyst is heated to the activation temperature of the catalyst within a short time and the catalyst coating layer can be elevated to a high temperature.

On the other hand, the heat generator A heats air around the heat generator A, and thus an air stream 5 is caused to circulate as a convection around the heat generator A. When the air stream 5 contacts the catalyst coating layer heated to the activation temperature by heating of the nichrome wire 1 or is diffused into the catalyst coating layer, smells or noxious components contained in the air around the heat generator A, for example, carbon monoxide (CO) or ammonia ($NH_3$) are purified by the catalytic action.

Thus, even if smells, cigarette smoke or noxious gases such as CO, etc. are suspended in the atmosphere in which the heat generator A is placed, they are purified by heating of the heat generator A and an agreeable heating atmosphere can be obtained.

EXAMPLE 2

Slurries were prepared in the same manner as in Example 1, except that the content of colloidal silica was changed between 1% and 60% by weight in terms of silica on the basis of total solid matters of slurry A prepared in Example 1, while correspondingly reducing the alumina content to make up for the silica increment, and heat generators each with 0.2 g of the catalyst coating layers formed on the entire outer surfaces of quartz tubes from the thus prepared individual slurries were prepared in the same manner as in Example 1. The thus prepared heat generators were subjected to a heat shock test to investigate the adhesion of the catalyst coating layers. The heat shock test was carried out by passing an electric current through the electric resistor contained in the quartz tube, setting the surface temperature at the center of the heat generator to intervals of 25° C., maintaining the heat generator at each interval for 10 minutes, and then dipping the heat generator into water at room temperature to investigate occurrence of peeling of the catalyst coating layer, and repeating the foregoing procedure until the peeling occurs, where the maximum temperature at which no peeling occurred was defined as a heat shock-resistant temperature. The results are shown in Table 1.

As is obvious from Table 1, the best adhesion (heat shock resistance) was obtained when the silica content was in a range of 6 to 40% by weight.

TABLE 1

| Silica content (wt %) | Heat shock-resistance temperature (°C.) |
|---|---|
| 0 | 400 |
| 3 | 450 |
| 4 | 475 |
| 5 | 550 |
| 6 | 700 |
| 7 | 700 |
| 8 | 700 |
| 10 | 700 |
| 35 | 700 |
| 38 | 700 |
| 39 | 700 |
| 40 | 700 |
| 41 | 650 |
| 42 | 625 |
| 45 | 550 |
| 60 | 525 |

EXAMPLE 3

1,000 g of a wash coat binder containing 10% by weight of alumina, 100 g of aluminum nitrate nonahydrate, 1,000 g of colloidal silica containing 20% by weight of silica, 1,200 g of water, 30 g of chloroplatinic acid in terms of Pt, 15 g of palladium chloride in terms of Pd, and cerium nitrate hexahydrate and active alumina powder in various ratios, the sum total of the cerium nitrate in terms of cerium oxide and the active alumina being 1,000 g, were added to a ball mill and thoroughly mixed to prepare slurries containing various amounts of cerium.

Then, heat generators each with the same amount of the catalyst coating layers containing various contents of cerium oxide, as shown in Table 2, as that of the catalyst coating layer of Example 1, formed on the surfaces of quartz tubes, were prepared from the thus prepared slurries in the same manner as in Example 1. Results of heat resistance tests of the heat generators are shown in Table 2.

The heat resistance test was carried out by firing the heat generators at 800° C. in air for 50 hours and then determining the CO purification efficiency of the fired heat generators. The CO purification efficiency was determined by placing the fired heat generator in a quartz tube, 15 mm in inner diameter, passing air containing 1,000 ppm CO therethrough at a space velocity of 10,000 $hr^{-}$ on the basis of the volume of the catalyst coating layer, while keeping the catalyst coating layer at 250° C., and measuring the CO concentration of the outgoing air, thereby determining the CO purification efficiency from the CO concentrations between the incoming air and the outgoing air.

As is obvious from Table 2, good heat resistance was obtained with cerium oxide content in a range between 5 and 30% by weight, and particularly best results were obtained between 10 and 28% by weight.

TABLE 2

| Cerium oxide content (wt %) | CO purification efficiency (%) |
|---|---|
| 0 | 82 |
| 2 | 83 |
| 4 | 85 |
| 5 | 90 |
| 6 | 90 |
| 7 | 90 |
| 10 | 91 |
| 20 | 91 |
| 28 | 91 |
| 29 | 90 |
| 30 | 90 |
| 31 | 86 |
| 32 | 85 |

EXAMPLE 4

830 g of active alumina powder, 1,000 g of a wash coat binder containing 10% by weight of alumina, 100 g of aluminum nitrate nonahydrate, 1,000 g of colloidal silica containing 20% by weight of silica, 30 g of chloroplatinic acid in terms of Pt, 15 g of palladium chloride in terms of Pd, and various ratios of barium hydroxide and active alumina powder, sum total of the barium hydroxide in terms of barium oxide and the active alumina being 1,000 g, were added to a ball mill, and thoroughly mixed to prepare slurries containing various amounts of barium.

Then, heat generators each with the same amount of the catalyst coating layers containing various contents of barium oxide, as shown in Table 3, as that of the catalyst coating layer of Example 1, formed on the surfaces of quartz tubes, were prepared from the thus prepared slurries in the same manner as in Example 1. Results of heat resistance tests and heat shock tests of the heat generators are shown in Table 3. The heat resistance tests were carried out in the same manner as in Example 3 and the heat shock tests were carried out in the same manner as in Example 2.

As is obvious from Table 3, the heat resistance of the catalyst coating layers was improved by the inclusion of barium oxide in the catalyst coating layers and good effects upon the heat shock resistance and CO purification efficiency were obtained particularly with a barium oxide content of 1 to 10% by weight.

As a barium oxide source, compounds capable of changing to barium oxide by thermal decomposition such as hydroxide, nitrate, etc. can be used in addition to the oxide.

TABLE 3

| Barium oxide content (wt %) | Heat shock-resistance temperature (°C.) | CO purification efficiency (%) |
|---|---|---|
| 0 | 700 | 82 |
| 0.5 | 700 | 84 |
| 0.8 | 700 | 86 |
| 0.9 | 700 | 92 |
| 1.5 | 700 | 92 |
| 2 | 700 | 92 |
| 5 | 700 | 92 |
| 8 | 700 | 92 |
| 10 | 700 | 92 |
| 11 | 625 | 92 |
| 12 | 500 | 92 |

EXAMPLE 5

A heat generator with a catalyst coating layer containing 5% by weight of barium carbonate in terms of barium oxide was prepared in the same manner as in Example 4, except that the slurry contained barium carbonate in place of barium hydroxide.

The thus prepared heat generator subjected to the heat resistance test and the heat shock test, and the results are shown in Table 4 in comparison with that of Example 4.

TABLE 4

| Barium oxide content (wt %) | Heat shock-resistance temperature (°C.) | CO purification efficiency (%) |
|---|---|---|
| 5.0[1)] | 700 | 92 |
| 5.0[2)] | 700 | 92 |

Remarks:
[1)]Barium hydroxide
[2)]Barium carbonate

As is obvious from Table 4, as good effects can be obtained with barium carbonate as with barium hydroxide.

EXAMPLE 6

A heat generator with a catalyst coating layer containing 5% by weight of cerium oxide and 3% by weight of barium oxide was prepared in the same manner as in Examples 3 and 4 and subjected to the heat resistance test. The result is shown in Table 5 in comparison with those of Examples 3 and 4.

TABLE 5

| Barium oxide content (wt %) | Cerium oxide content (wt %) | CO purification efficiency (%) |
|---|---|---|
| 0 | 8 | 90 |
| 8 | 0 | 92 |

TABLE 5-continued

| Barium oxide content (wt %) | Cerium oxide content (wt %) | CO purification efficiency (%) |
|---|---|---|
| 3 | 5 | 95 |

As is obvious from Table 5, CO leakage from the heat generators was 10% with single barium oxide and 8% with single cerium oxide, whereas it was reduced to about one-half thereof, that is, 5% with the simultaneous use of the two components, as compared with single use of barium oxide or cerium oxide, and thus the heat resistance could be improved thereby.

EXAMPLE 7

Slurries were prepared in the same manner as in Example 1, except that the content of titanium oxide was changed to between 0 and 35% by weight on the basis of total solid matters of slurry A prepared in Example 1, while correspondingly reducing the alumina content to make up for the titanium oxide increment, and heat generators each with 0.2 g of the catalyst layers formed on the entire surfaces of quartz tubes from the thus prepared individual slurries were prepared in the same manner as in Example 1. The thus prepared heat generators were subjected to an ammonia purification test and a heat shock test to investigate the adhesion of the catalyst coating layer. The results are shown in Table 6.

As is obvious from Table 6, the ammonia purification activity was shifted to a lower temperature side, that is improved by inclusion of titanium oxide in the catalyst coating layer, and a sufficient ammonia purification activity was obtained with a titanium oxide content by 4% by weight or higher. On the other hand, the heat shock resistance was lowered above 30% by weight of titanium oxide, and thus the desirable titanium oxide content was in a range of 4 to 30% by weight.

TABLE 6

| Titanium oxide content (wt %) | Heat shock-resistance temperature (°C.) | 90% ammonia purification temperature (°C.) |
|---|---|---|
| 0 | 700 | 300 |
| 2 | 700 | 290 |
| 3 | 700 | 285 |
| 4 | 700 | 263 |
| 5 | 700 | 261 |
| 7 | 700 | 261 |
| 20 | 700 | 261 |
| 28 | 700 | 261 |
| 29 | 700 | 261 |
| 30 | 700 | 261 |
| 31 | 625 | 261 |
| 35 | 500 | 261 |

EXAMPLE 8

Figure 2:
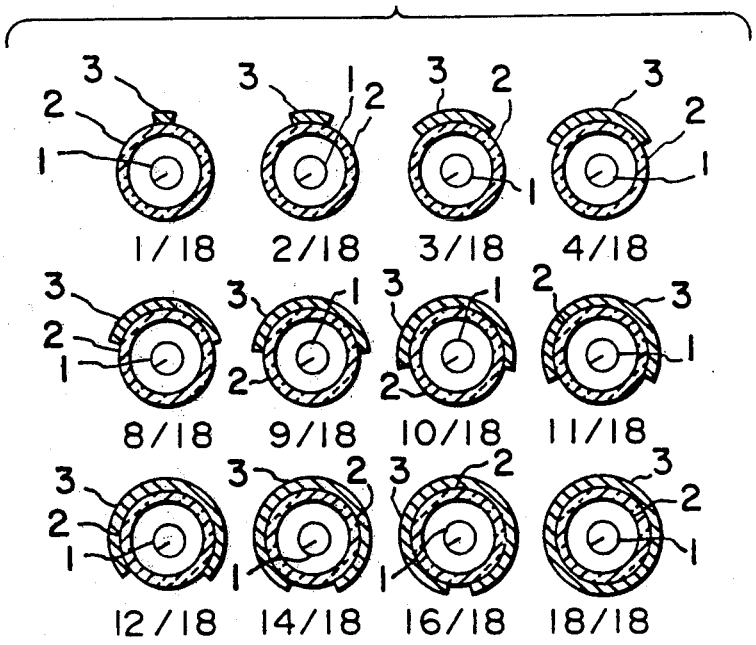
FIG. 2 is a view showing various coating coverages of the present catalyst coating layer provided on the surface of a quartz tube.

12 heat generators each with catalyst coating layers of the present invention were prepared from the same slurry A and quartz tubes as used in Example 1 by coating the outer surfaces of quartz tubes 2 with the slurry A to coverages of 1/18 to 18/18 (full coverage), as shown in FIG. 2 (in which 1 indicates a nichrome wire, 2 indicates a quartz tube and 3 indicates a catalyst coating layer), by spray coating in the same manner as in Example 1, drying the heat generators at 100° C. for 2 hours, followed by firing at 550° C. for one hour. The amount of the catalyst coating layers 3 was in a range of 0.011 to 0.20 g, while the layers 3 had an approximately constant layer thickness.

Then, the heat generators were subjected to the heat shock test in the same manner as in Example 2 to investigate the adhesion of the catalyst coating layers. The results are shown in Table 7.

As is obvious from Table 7, more heat shock-resistant catalyst coating layers could be obtained by covering more peripheral area than one-half round on the outer surface of the quartz tube, and thus it is desirable to cover more than one-half of the peripheral area around the outer surface of a quartz tube with a porous coating layer of high specific surface area.

TABLE 7

| Heat generator No. | Coverage of the peripheral surface with coating layer | Heat-resistant temperature (°C.) |
|---|---|---|
| 8-1 | 1/18 round | 600 |
| 8-2 | 3/18 round | 600 |
| 8-3 | 5/18 round | 600 |
| 8-4 | 7/18 round | 600 |
| 8-5 | 8/18 round | 600 |
| 8-6 | 9/18 round | 650 |
| 8-7 | 10/18 round | 700 |
| 8-8 | 11/18 round | 700 |
| 8-9 | 12/18 round | 700 |
| 8-10 | 14/18 round | 700 |
| 8-11 | 16/18 round | 700 |
| 8-12 | 18/18 round | 700 |

EXAMPLE 9

In the preparation of slurry A in Example 1, various slurries having main particle sizes of 0.8 to 15 μm were prepared by adjusting the milling time in the ball mill.

Heat generators each with 0.2 g of catalyst coating layers formed on the defatted and cleaned outer surfaces of quartz tubes from the thus prepared slurries were prepared in the same manner as in Example 1.

The hardness of the thus formed catalyst coating layers was investigated by a pencil hardness testing according to JIS G-3320. The results are shown in Table 8.

TABLE 8

| Main particle sizes (μm) | Pencil hardness |
|---|---|
| 0.8 | cracked |
| 0.9 | cracked |
| 1.0 | 4B |
| 1.2 | 4B |
| 1.5 | 4B |
| 2.0 | 4B |
| 5.0 | 4B |
| 9.0 | 4B |
| 9.2 | 5B |
| 10.0 | 6B |
| 11.0 | 6B |
| 15.0 | less than 6B |

As is obvious from Table 8, the catalyst coating layer become soft above main particle size of 9 μm, whereas below main particle sizes of 1 μm, the catalyst coating layer was liable to crack. Thus, it is desirable that the main particle size of particles in the slurry of the present invention be in the range of 1 to 9 μm.

In the foregoing Examples, the platinum group metals were added to the present catalyst coating layer by adding the platinum group metal salts to the slurry A and applying the slurry A to the surface of a quartz tube, but an alumina-silica coating layer can be formed on the surface of a quartz tube without adding the platinum group metal salts to the slurry A, and then platinum group metals can be supported on the alumina-silica coating layer by dipping. By comparison of these two procedures, the former procedure, i.e. initial addition of platinum group metal salts to slurry A, is desirable because better catalytic properties can be obtained.

As described above, the present heat generator can purify and remove smells or noxious gases such as cigarette smoke, etc. in the atmosphere, in which the heat generator is placed, by its catalytic action. Thus, the present heat generator can provide an agreeable heating atmosphere.

What is claimed is:

1. A quartz tube heat generator, comprising: a quartz tube, an electric resistor provided along a center line of the quartz tube, and a catalyst coating layer provided on an outer surface of the quartz tube, the catalyst coating layer being formed from a slurry containing colloidal silica, at least one member selected from the group consisting of active alumina and aluminum hydroxide, and a platinum group metal salt, the colloidal silica being present in an amount of 6 to 40% by weight in dried solid matters of the slurry after firing and particles of the slurry having a main particle size distribution of 1 to 9 μm, by applying the slurry to the outer surface of the quartz tube, followed by drying and firing.

2. A heat generator according to claim 1, wherein the catalyst coating layer contains barium oxide or barium carbonate.

3. A heat generator according to claim 1, wherein the catalyst coating layer contains 1 to 10% by weight of the barium oxide or the barium carbonate in terms of barium oxide.

4. A heat generator according to claim 1, wherein the catalyst coating layer contains cerium oxide.

5. A heat generator according to claim 4, wherein the catalyst coating layer contains 5 to 30% by weight of the cerium oxide.

6. A heat generator according to claim 1, wherein the catalyst coating layer contains titanium oxide.

7. A heat generator according to claim 6, wherein the catalyst layer contains 4 to 30% by weight of the titanium oxide.

8. A heat generator according to claim 1, wherein the catalyst coating layer covers more than one-half of a peripheral area around the outer surface of the quartz tube.

9. A heat generator according to claim 3, wherein the catalyst coating layer contains titanium oxide.

10. A heat generator according to claim 4, wherein the catalyst coating layer contains titanium oxide.

11. A heat generator according to claim 5, wherein the catalyst coating layer contains titanium oxide.

12. A heat generator according to claim 6, wherein the catalyst coating layer contains titanium oxide.

13. A heat generator according to claim 12, wherein the catalyst layer contains 4 to 30% by weight of the titanium oxide.

14. A heat generator according to claim 10, wherein the catalyst layer contains 4 to 30% by weight of the titanium oxide.

15. A heat generator according to claim 11, wherein the catalyst layer contains 4 to 30% by weight of the titanium oxide.

16. A heat generator according to claim 12, wherein the catalyst layer contains 4 to 30% by weight of the titanium oxide.

* * * * *